US009353561B2

(12) United States Patent
Gaenzle

(10) Patent No.: US 9,353,561 B2
(45) Date of Patent: May 31, 2016

(54) 180 DEGREE FOLDABLE LOCKING HINGE

(71) Applicant: Ronnie Gaenzle, East Setauket, NY (US)

(72) Inventor: Ronnie Gaenzle, East Setauket, NY (US)

( * ) Notice: Subject to any disclaimer, the term of this patent is extended or adjusted under 35 U.S.C. 154(b) by 74 days.

(21) Appl. No.: 14/300,928

(22) Filed: Jun. 10, 2014

(65) Prior Publication Data

US 2015/0067985 A1 Mar. 12, 2015

Related U.S. Application Data

(60) Provisional application No. 61/833,145, filed on Jun. 10, 2013.

(51) Int. Cl.
*E05D 3/02* (2006.01)
*E05D 11/10* (2006.01)

(52) U.S. Cl.
CPC ..... *E05D 11/1007* (2013.01); *E05D 3/022* (2013.01); *Y10T 16/54* (2015.01); *Y10T 16/544* (2015.01); *Y10T 16/5448* (2015.01)

(58) Field of Classification Search
CPC . E05D 11/1007; E05D 11/10; E05D 11/1014; E05D 11/1028; E05D 11/105; E05D 11/1064; E05D 3/022; E05D 3/18; Y10T 16/54; Y10T 16/5401; Y10T 16/5402; Y10T 16/54025; Y10T 16/540257; Y10T 16/54029; Y10T 16/54048; Y10T 16/54052; Y10T 16/5404; Y10T 16/54056; Y10T 16/5406; Y10T 16/5408; Y10T 16/5409; Y10T 16/544; Y10T 16/5445; Y10T 16/5448; E05F 1/1246; E05F 1/1269; E05F 1/1276; A61G 2007/051; A47C 21/08; A47B 1/03; B65D 43/164; B65D 43/12; B60N 3/102
See application file for complete search history.

(56) References Cited

U.S. PATENT DOCUMENTS 125,281 A * 4/1872 Garver ..... E05D 3/022 16/364
126,571 A * 5/1872 Otis ..... E05D 3/022 16/364
126,647 A * 5/1872 Otis ..... E05D 11/1014 16/297
130,472 A * 8/1872 Brinser ..... E05D 3/022 16/361
158,063 A * 12/1874 Grimm ..... E05D 3/022 16/364
461,908 A * 10/1891 Wolf ..... E05D 11/1014 16/291
461,909 A * 10/1891 Wolf ..... E05D 11/1014 16/291
472,622 A * 4/1892 Linkletter ..... E05D 3/022 16/361
993,154 A * 5/1911 Dailey ..... E05D 11/1007 16/348

(Continued)

FOREIGN PATENT DOCUMENTS

CA 2114475 7/1995

*Primary Examiner* — Jeffrey O Brien
(74) *Attorney, Agent, or Firm* — Ware, Fressola, Maguire & Barber, LLP

(57) ABSTRACT

A foldable locking hinge is provided that is configured for use in an apparatus is described. The apparatus may secured to the underside of a surface, such as a chair or a table, and allow an individual to safely and securely position an object in front of them while in use, and then rotate the object 180° to safely and securely reposition the object under the surface to which the apparatus is attached. The apparatus includes a housing and a plank secured to the housing. The housing includes an elongated slot and a cavity positioned adjacent to and parallel with the elongated slot.
The elongated slot and the cavity of the housing are each configured to at least partially receive the plank and the plank is configured to rotate 180°.

13 Claims, 12 Drawing Sheets

(56) References Cited

U.S. PATENT DOCUMENTS 1,282,435 A * 10/1918 Korb ..... E05D 3/18 16/360
1,302,178 A * 4/1919 Korb ..... E05D 3/18 16/360
1,418,919 A * 6/1922 Leverne ..... E05F 1/1269 16/286
1,644,440 A * 10/1927 Noack ..... E05D 3/12 16/348
1,655,716 A * 1/1928 Soss ..... E05D 3/186 16/348
1,770,104 A * 7/1930 Fox ..... A47B 3/087 108/67
1,997,043 A * 4/1935 Clark ..... A24F 15/18 131/242
2,205,484 A * 6/1940 Hunter ..... E05D 3/12 16/350
2,211,581 A * 8/1940 Ross ..... E05D 3/02 16/364
2,699,975 A * 1/1955 Ranney ..... A47B 1/03 108/67
2,948,009 A * 8/1960 Mesi ..... A46B 5/0033 15/144.1
4,131,259 A 12/1978 Franks
4,615,461 A * 10/1986 Liu ..... H05K 13/0084 206/45.23
4,697,780 A 10/1987 Wenkman et al.
4,795,211 A 1/1989 Stern et al.
5,137,321 A 8/1992 Landry et al.
5,150,806 A * 9/1992 Glomski ..... B65F 1/646 220/815
5,217,277 A 6/1993 Rasnick et al.
5,474,272 A 12/1995 Thompson et al.
5,549,199 A * 8/1996 Lindsay ..... G11B 33/0427 206/308.1
5,784,732 A * 7/1998 Vail ..... A47C 21/08 16/350
5,944,293 A * 8/1999 Loy ..... B64C 25/60 248/202.1
6,010,104 A 1/2000 Hanson et al.
6,059,138 A 5/2000 Labruyere
6,196,405 B1 * 3/2001 Kambouris ..... B65D 43/164 206/701
6,227,511 B1 5/2001 De Costa
6,606,762 B1 * 8/2003 Levine ..... G06F 1/1626 16/286
6,823,927 B2 * 11/2004 Steel ..... E05D 3/022 16/49
6,994,410 B2 2/2006 Hogan
7,010,833 B2 * 3/2006 Duarte ..... E04H 4/084 16/358
7,207,512 B2 * 4/2007 Webb ..... A47J 43/25 16/438
7,344,208 B2 3/2008 Brown
7,780,037 B2 * 8/2010 Corbellini ..... A45D 33/006 220/811
7,849,863 B2 * 12/2010 Corbellini ..... A45D 33/22 132/295
7,959,242 B2 6/2011 Del Castillo
D652,706 S 1/2012 Osaki
8,231,187 B2 7/2012 Hoffman
8,272,104 B2 * 9/2012 Chen ..... G06F 1/1616 16/327
8,281,459 B2 * 10/2012 Le ..... E05D 3/022 16/350
8,297,207 B2 10/2012 Liu
8,428,250 B2 * 4/2013 Hsu ..... H04M 1/0237 379/433.12
8,434,197 B2 * 5/2013 Oshima ..... E05D 3/186 16/241
8,482,906 B2 * 7/2013 Farley, Jr. ..... E05D 3/022 16/103
8,520,377 B2 * 8/2013 Senatori ..... G06F 1/1681 361/679.26
8,635,743 B2 * 1/2014 Smith ..... F16C 11/045 16/382
8,850,661 B2 * 10/2014 Liermann ..... E05D 3/186 16/357
9,025,329 B2 * 5/2015 Sung ..... G06F 1/162 16/221
9,091,105 B2 * 7/2015 Sayama ..... E05D 3/18
9,097,048 B2 * 8/2015 McCullough ..... A47B 3/08
2005/0051690 A1 3/2005 Phillips et al.
2006/0022106 A1 2/2006 Mackin
2009/0100639 A1 * 4/2009 Tao ..... G06F 1/1643 16/250
2012/0327564 A1 12/2012 Lin et al.
2014/0366448 A1 * 12/2014 Tschap ..... E05D 15/30 49/252

* cited by examiner

180 DEGREE FOLDABLE LOCKING HINGE

CROSS-REFERENCE TO RELATED APPLICATIONS

This application claims the benefit of U.S. Provisional Application No. 61/833,145, filed Jun. 10, 2013, which is hereby incorporated by reference in its entirety.

FIELD OF THE INVENTION

The present invention relates to a foldable locking hinge that can be used to rotate an object secured to an apparatus 180 degrees.

BACKGROUND OF THE INVENTION

There is a need in the art for an adaptable, foldable hinge that permits an individual to position in object in a first, accessible location when the object is in use, and then conveniently reposition that object in a second, obscured location when the object is not in use, and vice versa. There is an additional need in the art for the an apparatus embodying such a foldable hinge that can be used in public or private settings by securing the apparatus underneath a surface, such as a seat or a table.

It is an object of the present to address these needs in the art.

SUMMARY OF THE INVENTION

The present invention relates to a foldable locking hinge that is configured for use in an apparatus. The apparatus may be secured to the underside of a surface, such as a chair or a table, and allow an individual to safely and securely position an object in front of them while in use, and then rotate the object 180° to safely and securely reposition the object under the surface to which the apparatus is attached. The user may, with the apparatus, take an object such as a beverage stored in a cup holder secured to a plank on the apparatus, and when the cup holder is not in use, rotate the cup holder and plank 180° to store the cup holder out of the user's way.

According to a first embodiment of the invention, there is an apparatus comprising a housing and a plank secured to the housing. The housing includes an elongated slot and a cavity positioned adjacent to and parallel with the elongated slot. The elongated slot and the cavity of the housing are each configured to at least partially receive the plank and the plank is configured to rotate 180°.

In the apparatus according to the first embodiment of the invention, the plank may comprise a rod extending through the plank configured to secure the plank to the housing. The cavity of the housing may comprise a track to receive the rod and permit lateral movement of the rod and the plank into or out of the cavity. When the plank is removed from the cavity, the rod is maintained within the track and is configured to allow the plank to pivot towards the housing into the slot. In particular, a portion of the track extends perpendicularly into the elongated slot of the housing and this extended portion of the track is configured to receive the rod to enable the 180° rotation of the plank into and out of the elongated slot.

Further in the apparatus according to the first embodiment of the invention, the plank may comprise a magnetic member and the housing may comprise a first magnetic member. The first magnetic member of the housing is configured to align with the plank magnetic member when the plank is inserted into the slot, which aids to secure the plank in the slot. The housing may also comprise a second magnetic member configured to align with the rod when the plank is inserted into the cavity, which aids to secure the plank in the cavity.

In the apparatus according to the first embodiment of the invention, the housing may comprise a first plate configured to be secured to a second plate. The cavity may formed in a space between the first plate and the second plate and the slot is formed between opposing side walls on the second plate.

The plank in the apparatus according to the first embodiment of the invention is configured to be affixed to an object, such as a cup holder.

The apparatus according to the first embodiment of the invention may comprise one or more bore holes to secure the apparatus to a surface by a bolt or screw inserted through the one or more bore holes.

According to a second embodiment of the invention, the cavity in the housing of the apparatus may comprise a spring element configured to be secured to the rod of the plank and to bias the plank towards the inside of the cavity when the plank is aligned with the cavity.

According to a third embodiment of the invention, the housing of the apparatus may comprise a rotatable latch adjacent to the slot configured to secure the plank in the slot by rotating the latch over the plank. According to the third embodiment, the cavity of the apparatus may be formed between the housing and the surface to which the apparatus is secured.

Having summarized the present invention herein, the invention will now be described in further detail in reference to the accompanying Figures.

DETAILED DESCRIPTION OF THE INVENTION

Figure 1A:
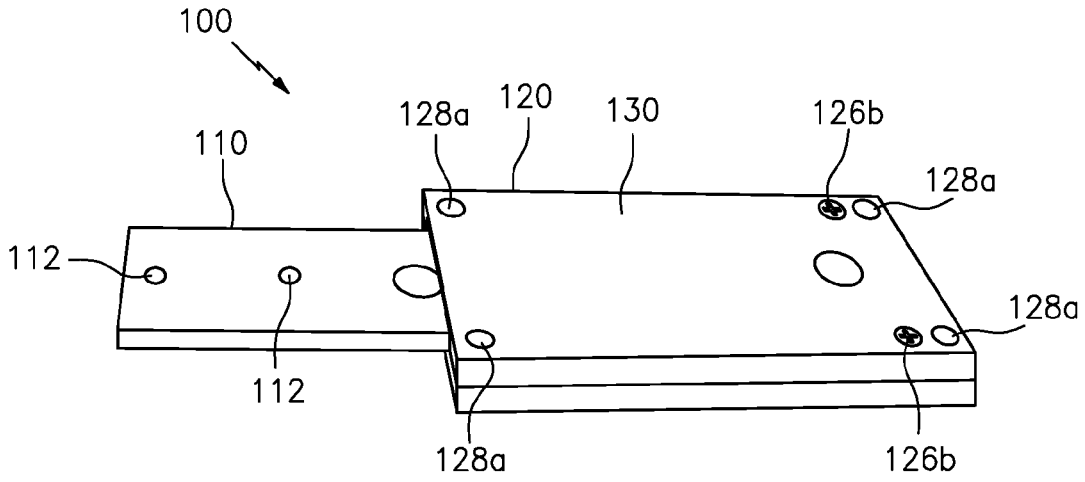
FIG. 1A shows a first view of an apparatus according to a first embodiment of the present invention, with the plank inserted in the cavity of the apparatus.

According to a first embodiment of the invention, shown in FIGS. 1A-5E, the foldable locking hinge is embodied in an apparatus 100 for securing and rotating a plank 110 180 degrees. The apparatus 100 comprises the plank 110 and a housing 120. The housing 120 includes a cavity 122 and a slot 124 in an overlaying and parallel relationship as seen in FIG. 1F. The cavity 122 and slot 124 are each dimensioned for receiving the plank 110.

The plank 110 is an elongated, substantially flattened member capable of supporting an object, such as a cup holder 300. The plank 110 may be configured with an bore hole or plurality of bore holes 112 used to secure the plank 110 to the cup holder 300 or other object by means of a screw or other securing member (not shown) through the plank bore holes 112 and the object 300. The plank 110 may include a means for securing the plank 110 to the housing 120 and preventing the plank 110 from unintentionally rotating away from the slot 124 of the housing 120. In the embodiment shown in FIGS. 1A-5E, the plank 110 comprises a magnetic member 114 configured to engage the plank 110 to the housing 120 within the slot 124. The plank 110 further includes a rod 116 inserted through an end of the plank 110. The rod 116 is configured to permit the plank 110 to slide into and out of the cavity 122 of the housing 110 and rotate 180 degrees. In a preferred embodiment, the rod 116 is positioned on an end of the plank 110 opposite the end of the plank 110 comprising the bore holes 112, or secured to an object 300. In a preferred embodiment, the rod 116 would be formed from a metallic material, however, the construction of the rod 116 is not limited to this material.

In the embodiment shown in FIGS. 1A-5E, the housing 120 is comprised of two components, a top plate 130 and a base plate 140. The two plates 130 and 140 are secured together by inserting one or more screws or bolts 126*b* through bore holes 126*a* in the housing 120. The bore holes 126*a* and screws or bolts 126*b* extend through both the top and base plates 130 and 140. The housing 120 includes bore holes 128*a* which are configured to receive screws or bolts 128*b* in order to affix the housing 120 to a surface 200. The housing 120 is not intended to be limited by the particular number or size of the bore holes 126*a* and 128*a* shown in the Figures, which can vary. The invention is further not limited to the particular configuration of the screw or bolt 126*b* and 128*b* shown in the Figures, but alternative means can be used for securing the two plates 130 and 140 of the housing 110 together, or for securing the housing 110 to a surface 200. Additionally, in alternative embodiments, the housing 120 may comprise a similar structure and configuration but made from a single piece of material.

Figure 3B:
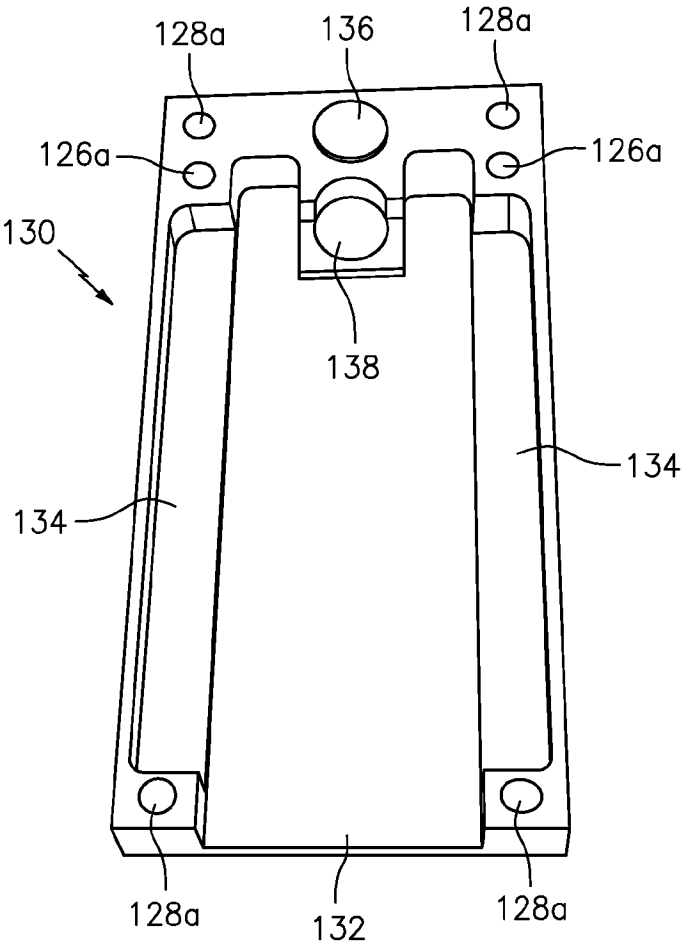
FIG. 3B shows a second view of the top plate of the apparatus according to the first embodiment of the present invention.
Figure 3A:
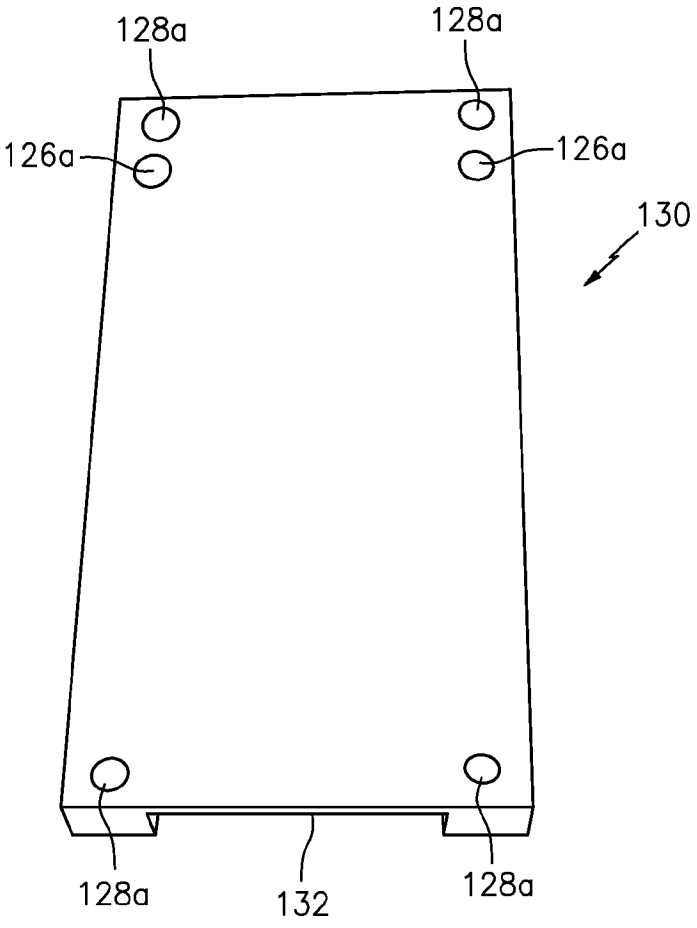
FIG. 3A shows a first view of a top plate of the apparatus according to the first embodiment of the present invention.
Figure 4B:
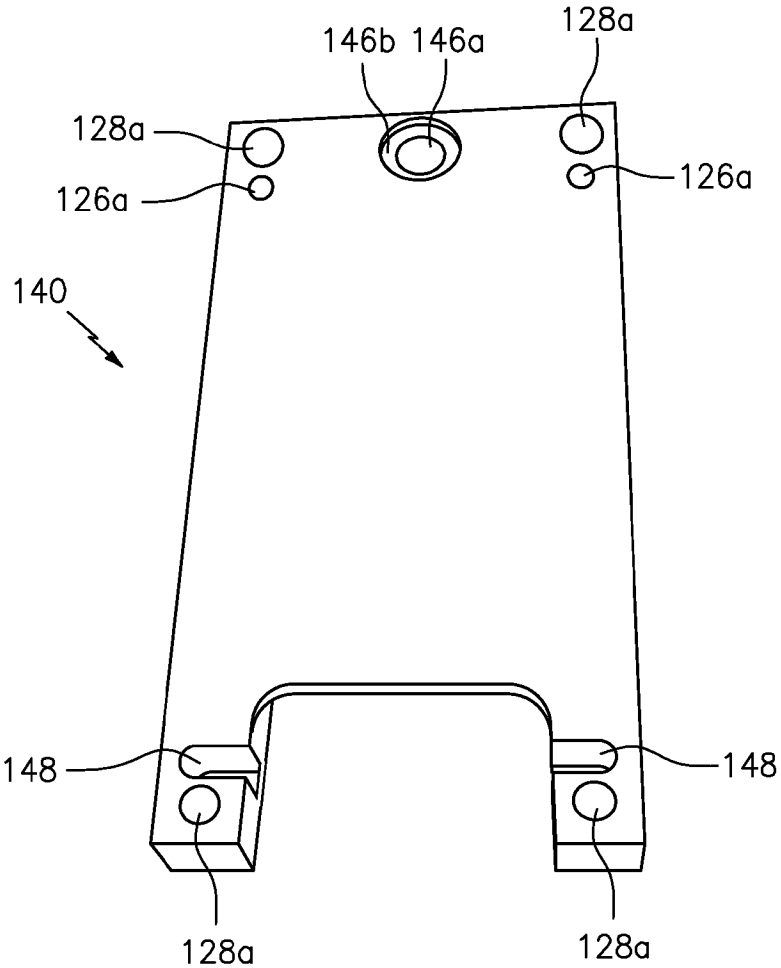
FIG. 4B shows a second view of the base plate of the apparatus according to the first embodiment of the present invention.
Figure 4A:
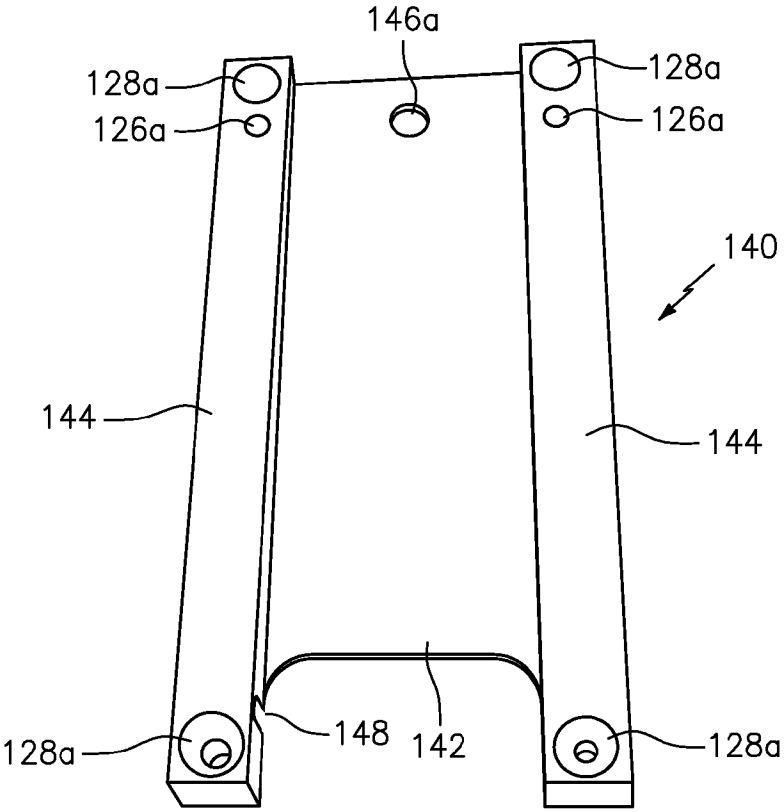
FIG. 4A shows a first view of a base plate of the apparatus according to the first embodiment of the present invention.

The top plate 130 can be seen in detail in FIGS. 3A and 3B. The top plate 130 may have a substantially flat surface, as seen in FIG. 3A, which abuts the surface 200 of the object to which the apparatus 100 is secured. Underneath this flat surface, the top plate 130 provides the space for the cavity 122. A plank receiving section 132 is configured in between two tracks 134. The plank receiving section 132 is dimensioned in width so as to fit the plank 110. The tracks 134, elevated above the plank receiving section 132, are configured to receive the ends of the rod 116 when the plank 110 is maintained in the plank receiving section 132. When the plank 110 is contained in the top plate 130, the plank 110 can be slid through the plank receiving section 132 with the rod 116 sliding through the tracks 134.

The top plate 130 is further configured with a first magnetic member 136 and a second magnetic member 138. As described in further detail below, the first magnetic member 136 is configured so as to be aligned with an opening 146*a* in the base plate 140, and when the plank 110 is in the slot 124, aligned with the magnetic member 114 of the plank 110. The second magnetic member 138 is positioned within the plank receiving section 132 such that the rod 116, which in this embodiment is metallic, is positioned near and attracted to the second magnetic member 138. This magnetic effect secures the plank 110 within the cavity 122 of the housing 120.

The base plate 140 of the housing 120, as shown in FIGS. 3A and 3B, includes a plate 142 having two elongated side walls 144 on each side. The plate 142 and side walls 144 correspond to the slot 124 of the housing 120. The bottom plate 140 is configured for attachment to the top plate 130 via the bore holes 126*a* and screws or bolts 126*b*. The base plate 140 includes one flattened side opposite the side comprising the side walls 144, shown in FIG. 3B, which is positioned adjacent to the top plate 130 when the housing 120 is in its assembled form. When the flattened side of base plate 140 overlays the plank receiving section 132 and the tracks 134, it forms a cavity 122 in which the plank 110 can be stored, inserted or removed. The flattened side of the base plate 140 may further be configured with a rim 146*b* around the opening 146*a* which is configured to align with the first magnetic member 136 and may improve the fit of the attached top plate 130 and base plate 140.

The base plate 140 further includes a vertical extension 148 of the tracks 134 which aid in providing the 180 degree hinge mechanism according to the invention. In a preferred embodiment, the vertical extensions 148 are positioned on the base plate 140 on an end substantially opposing the opening 146*a*, and when the base plate 140 is attached to the top plate 130, opposing the first magnetic member 134 and aligning with an end of the tracks 144. The plate 142 is dimensioned in a preferred embodiment so as to be shorter in length than the side walls 144, so that the vertical extensions 148 are constructed in the side walls 144 at a point in between the ends of the side walls 144 and the end of the plate 142. The vertical extensions 148 may be similar in width to the width of the tracks 144 and dimensioned to receive the rod 116 extending from the plank 110.

The 180 degree foldable hinge according to the invention will now be described in reference to FIGS. 1B-1E.

Figure 1B:
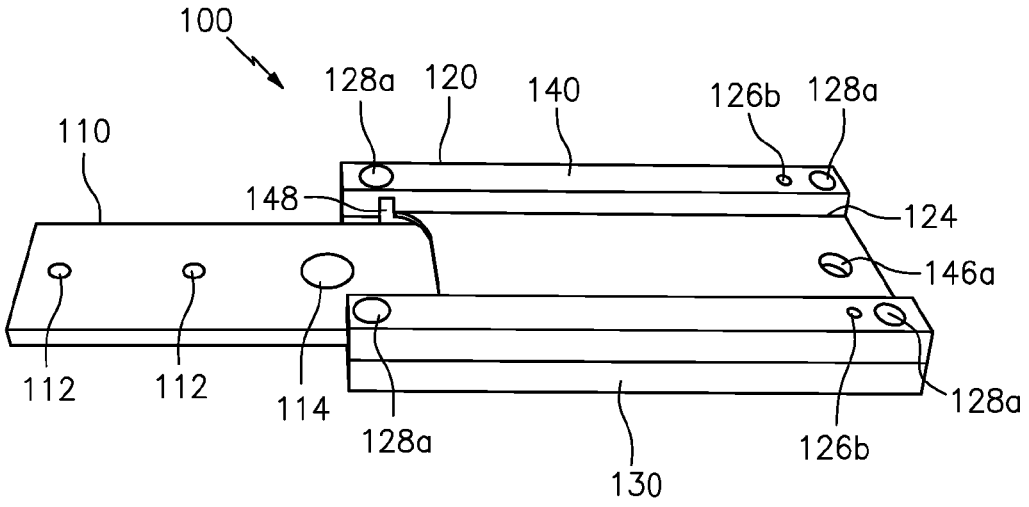
FIG. 1B shows a second view of the apparatus according to the first embodiment of the present invention, from the side opposite the view shown in FIG. 1A, with the plank inserted in the cavity of the apparatus.
Figure 1C:
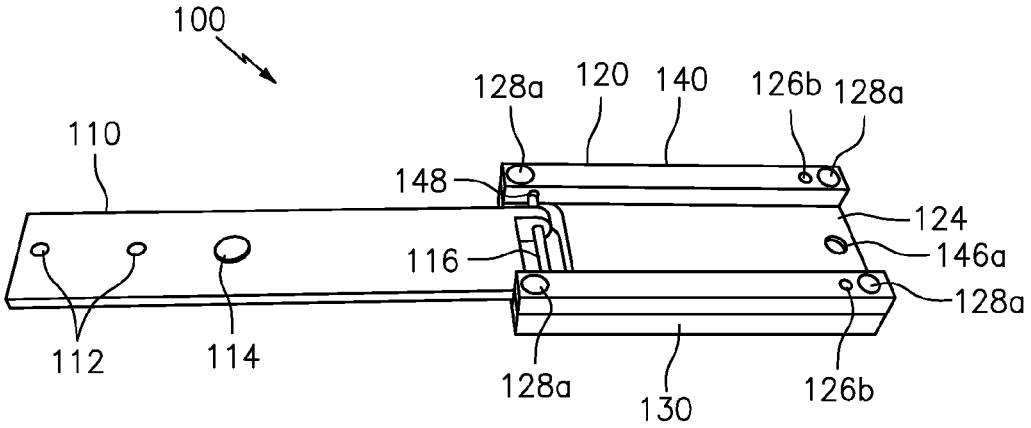
FIG. 1C shows the apparatus according to the first embodiment of the present invention, with the plank removed from the cavity of the apparatus.
Figure 1E:
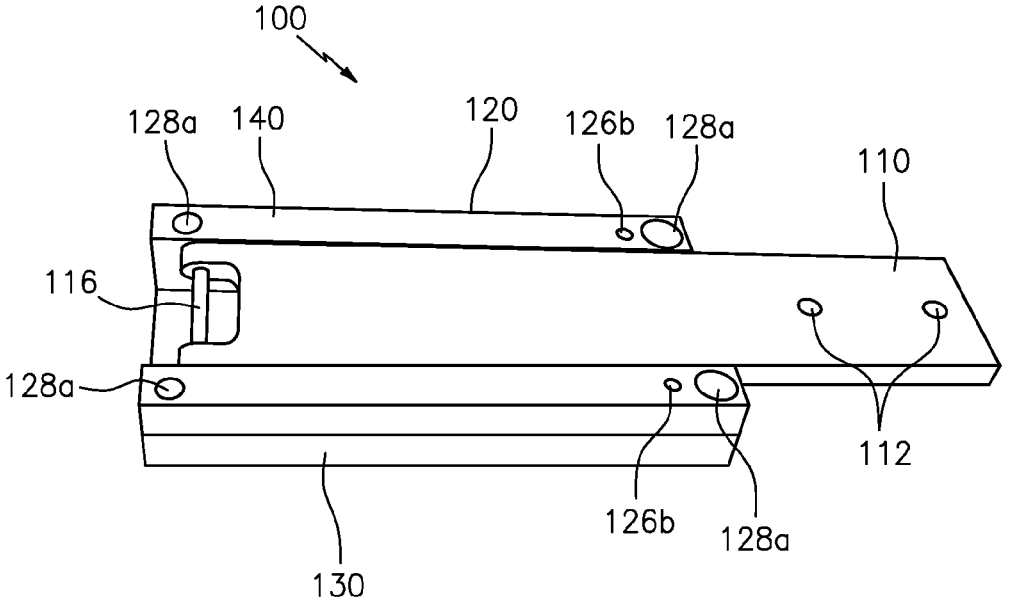
FIG. 1E shows the apparatus according to the first embodiment of the present invention, with the plank in the slot.
Figure 1D:
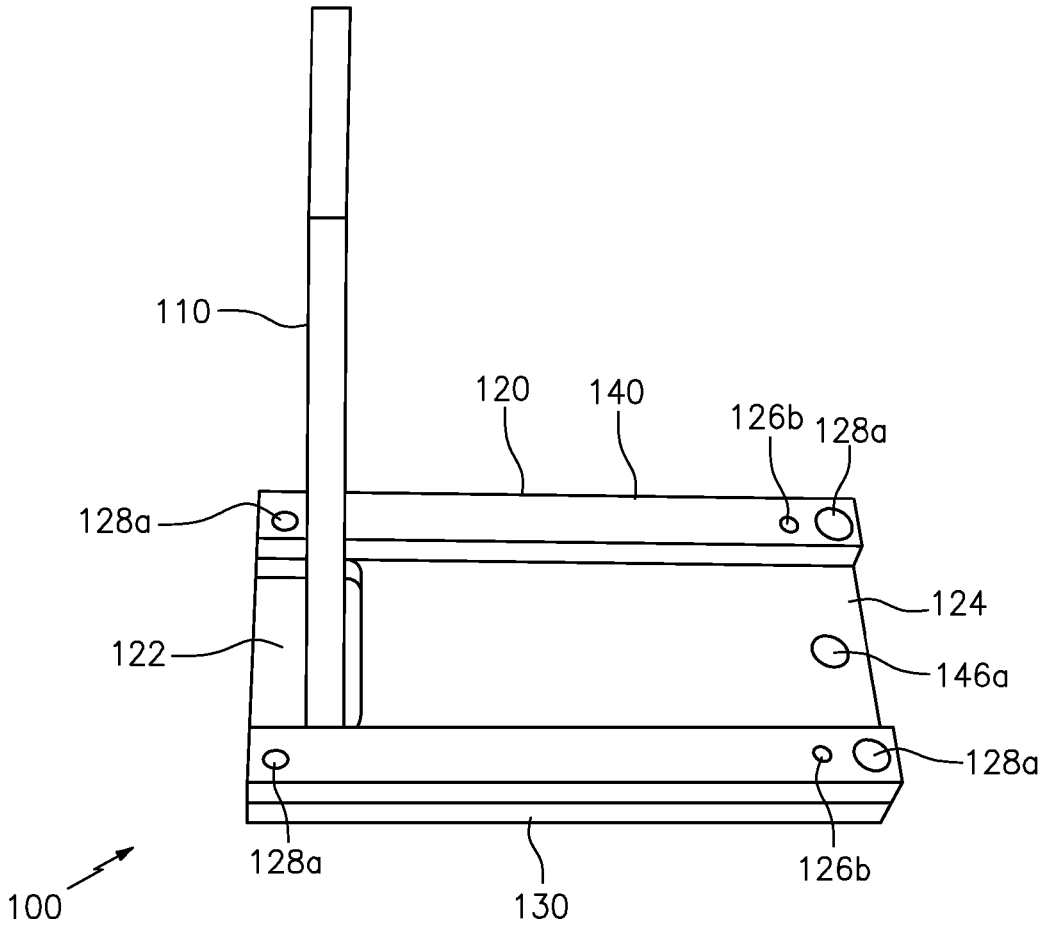
FIG. 1D shows the apparatus according to the first embodiment of the present invention, with the plank in the process of rotating into the slot.
Figure 1F:
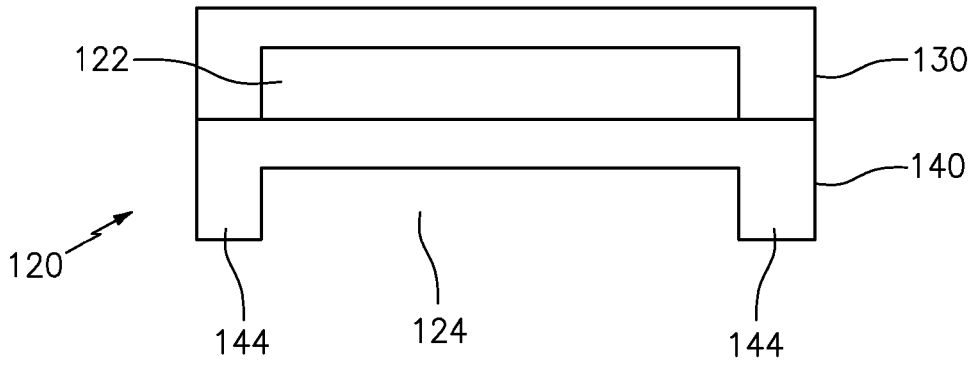
FIG. 1F shows a side view of the housing of the apparatus according to the first embodiment of the present invention.
Figure 2B:
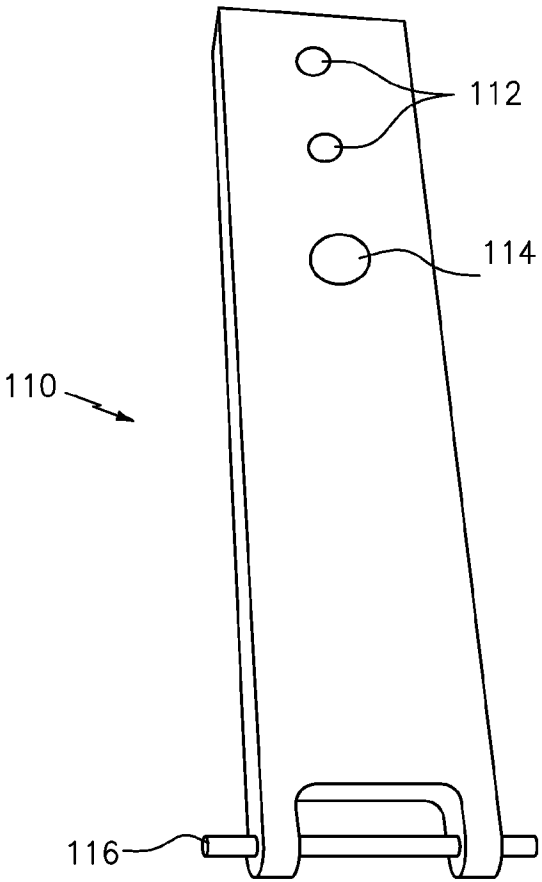
FIG. 2B a second view of the plank of the apparatus according to the first embodiment of the present invention.
Figure 2A:
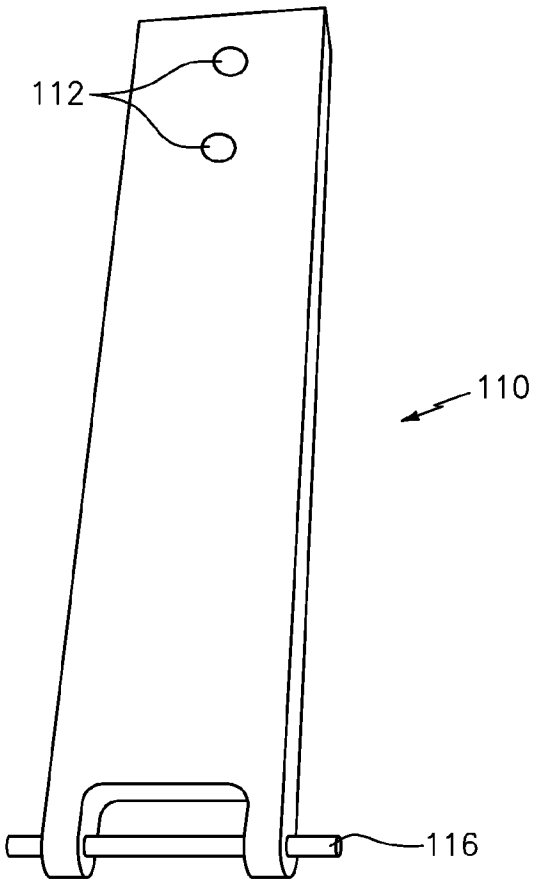
FIG. 2A shows a first view of the plank of the apparatus according to the first embodiment of the present invention.

As shown in FIG. 1B, the plank 110 can be secured inside the cavity 122 of the housing 120, formed in between the top plate 130 and base plate 140. By applying a pulling force to the plank 110 to separate the rod 116 from the second magnetic member 138 inside the cavity 122, the plank 110 can be pulled out of the cavity 120 by sliding the rod 116 along tracks 144. The plank 110 can be extended fully out of the cavity 120, while leaving the ends of the rod 116 in the track 144 as the rod 116 reaches the end of track 144 on the top plate, as shown in FIG. 1C. From this position, the plank 110 can be rotated back towards the housing 120, as shown in FIG. 1D. While the plank 110 is positioned in the cavity 122, the plank is prevented from making such rotation by the base plate 140. As the plank 110 rotates towards the housing 120, the plank 110 can be lifted upwards, or if the apparatus 110 is secured to a surface 200 as in FIGS. 5A-5E, the plank 110 falls downward, by the rod 116 entering the vertical extensions 148. From this position, the plank 110 can freely continue its rotation into the slot 124, as shown in FIG. 1E. The plank 110 is secured in the slot 124 by the attraction of the magnetic means 114 on the plank 110 to the first magnetic means 136 of the housing 120. The process of rotating the plank 110 can be reversed by pulling the plank 110 away from the slot 124, and reversing the rotation until the plank 110 is inserted back into the cavity 122.

As a result of this construction of the apparatus 100 and its hinge mechanism described above, the apparatus 100 can be used in an exemplary embodiment for moving an article into and out of view for convenience. For example, as shown in FIGS. 5A-5D, the apparatus 100 may be affixed to a surface 200 and to a cup holder 300. The surface 200 can be the bottom of a seat or an arm rest of a transportation vehicle for example, such as a bus, plane, train, car or other vehicle. The cup holder 300 can be secured to the plank 110 of the apparatus using any known means, including by inserting a screw or bolt (not shown) through the plank bore hole or holes 112 and the cup holder 300 to secure the plank 110 and cup holder 300 together.

Figure 5A:
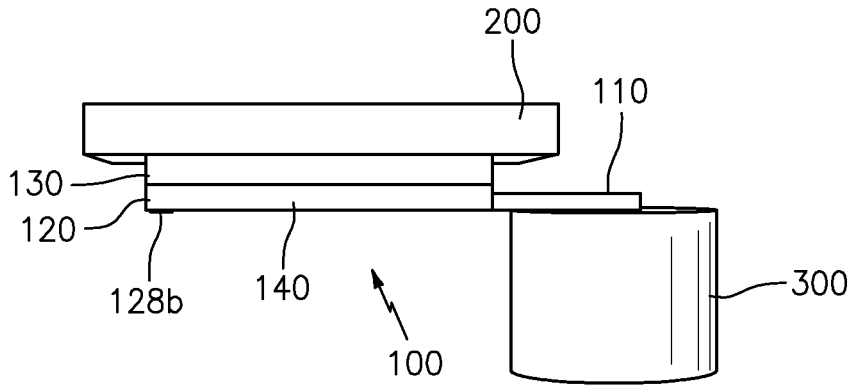
FIG. 5A shows the apparatus according to the first embodiment of the present invention secured to a surface, with the plank in the slot.
Figure 5B:
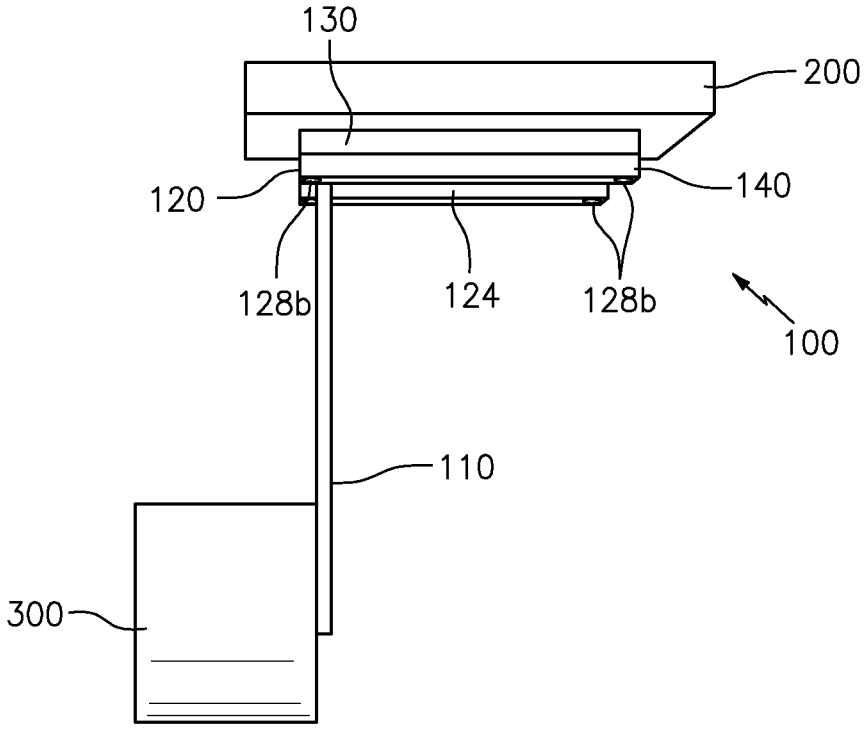
FIG. 5B shows the apparatus according to the first embodiment of the present invention secured to a surface, with the plank in the process of rotating into the slot
Figure 5C:
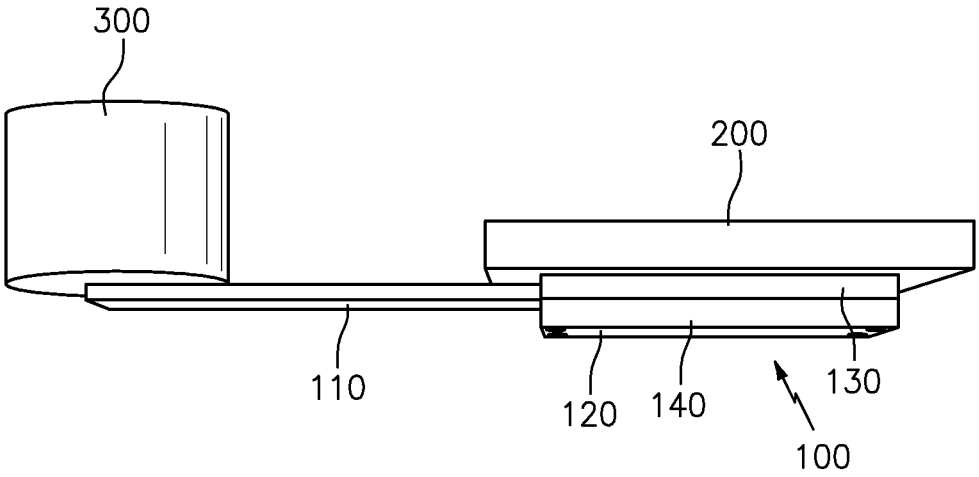
FIG. 5C shows the apparatus according to the first embodiment of the present invention secured to a surface, with the plank removed from the cavity of the apparatus.
Figure 5D:
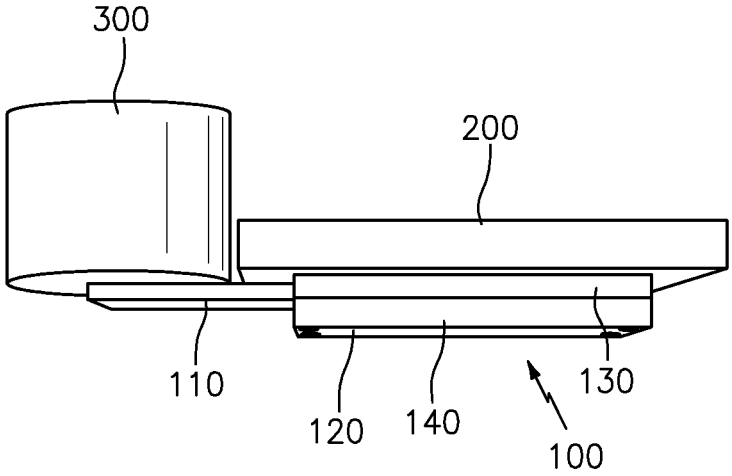
FIG. 5D shows the apparatus according to the first embodiment of the present invention secured to a surface, with the plank inserted in the cavity of the apparatus.

The hinge mechanism of the apparatus 100 as shown in FIGS. 1B-1E is the same as shown in FIGS. 5A-5D, which includes the surface 200 and cup holder 300. When the cup holder 300 is not being used, it can be stored beneath the surface 200 by securing the plank 110 to the slot 124 of the housing 120, as shown in FIG. 5A. When the user desires to use the cup holder 300, the cup holder 300 can be pulled away from the slot 124, as seen in FIG. 5B, and extended in front of the user, as seen in FIG. 5C. The plank 110 supporting the cup holder 300 can be slid into the cavity 122 of the housing 120 of the apparatus 100 to further secure the cup holder 300 in place and prevent it from falling downwardly. When the cup holder 300 is no longer in use, the plank 110 can be rotated back under the surface 200 by reversing the process. The combined apparatus 100 and cup holder 300 is not limited to use solely with a transportation vehicle, but can also be used in connection with any other use where a cup holder 300 is desired and where it can be conveniently moved into and out of the user's way depending on when use of the cup holder 300 is necessary. For example, the apparatus 100 and cup holder 300 can be used in connection with tables, wheel chairs, beds, stadium seats, movie theater seats, bars, clubs, or any other application that may be deemed appropriate.

The apparatus 100 may also be used with objects other than a cup holder 300 secured to the plank 110. For example, the apparatus can be used as a table extender for use with tables that may require extensions or variable sizes, such as a massage table. A table extension can be secured to the apparatus 100, which can be secured to the bottom of a massage table. If the massage table needs to be extended in length or width to meet the size of a person using the table, the extension can be rotated from underneath the table into alignment with the table in order to increase the width and/or length of the table. Additionally, the locking hinge described herein can also be used in combination with a box having a snapping lid, a pull out shelf, a pull out table, a pocketbook holder, a makeup mirror, drop down lighting, emergency lighting, a plant holder, a flower pot, a baby changing table or an ashtray, for example. If mounted at 90 degree angle can the apparatus can be used as a privacy partition, cubicle walls, privacy screens, or room dividers.

The apparatus 100 is not limited to any particular set of dimensions, but can vary in size depending on the use. Additionally, although the apparatus 100, including the plank 110, housing 120, top plate 130 and base plate 140 are configured from a suitable plastic material such as polypropylene or polyvinyl chloride, the invention is not limited to being constructed from any particular material substance, but can also be constructed from other materials, including but not limited to metallic materials such as aluminum.

According to a second embodiment of the invention, the apparatus according to the present invention may include a spring to retain the plank within the cavity rather than a magnetic member. This embodiment is discussed herein with reference to FIGS. 6A-6E.

The apparatus 400 according to the second embodiment of the invention is comprises similar components as the apparatus 100 according to the first embodiment of the invention. The apparatus 400 comprises a plank 410 and a housing 420. The housing 420 includes a cavity 422 and a slot 424 in an overlaying and parallel relationship. The cavity 422 and slot 424 are each dimensioned for receiving the plank 410.

The plank 410 may be configured with a bore hole or plurality of bore holes 412 used to secure the plank 410 to an object by means of a screw or other securing member (not shown) through the plank bore holes 412 and the object. The plank 410 may include a means for securing the plank 420 to the housing 420 and preventing the plank 410 from unintentionally rotating away from the slot 424 of the housing 420. In the embodiment shown in FIGS. 6A-6E, the plank 410 comprises a magnetic member 414 configured to engage the plank 410 to the housing 420 within the slot 424. The plank 410 further includes a rod 416 inserted through an end of the plank 410. The rod 416 is configured to permit the plank 410 to slide into and out of the cavity 422 of the housing 420 and rotate 180 degrees. In a preferred embodiment, the rod 416 is positioned on an end of the plank 410 opposite the end of the plank 410 comprising the bore holes 412, or secured to an object.

The housing 420 is comprised of two components, a top plate 430 and a base plate 440. The two plates 430 and 440 are secured together by inserting one or more screws or bolts 426*b* through bore holes 426*a* in the housing 420. The bore holes 426*a* and screws or bolts 426*b* extend through both the top and base plates 430 and 440. The housing 420 includes bore holes 428*a* which are configured to receive screws or bolts (not shown) in order to affix the housing 420 to a surface 200.

Figure 6A:
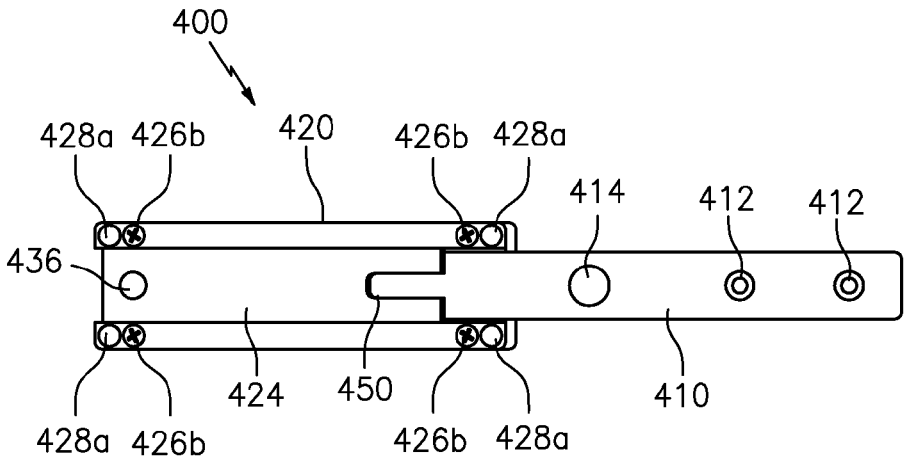
FIG. 6A shows a first view of an apparatus according to a second embodiment of the present invention, with the plank inserted in the cavity of the apparatus.
Figure 6B:
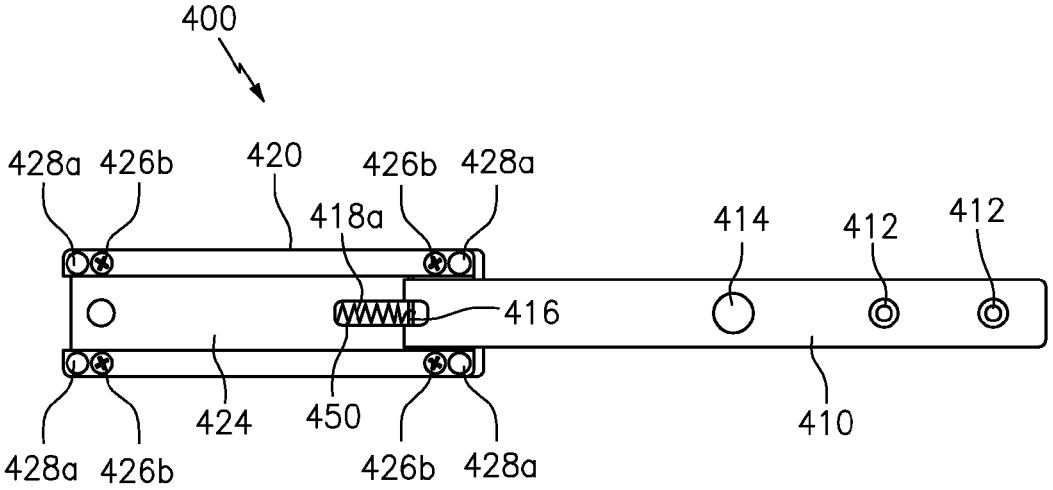
FIG. 6B shows a second view of the apparatus according to the second embodiment of the present invention, with the plank removed from the cavity of the apparatus.
Figure 6C:
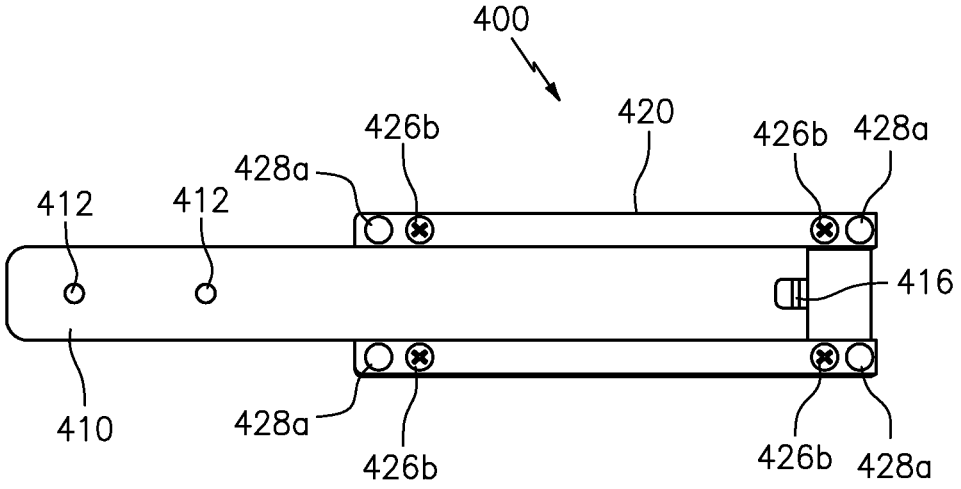
FIG. 6C shows the apparatus according to the second embodiment of the present invention, with the plank in the slot.
Figure 6D:
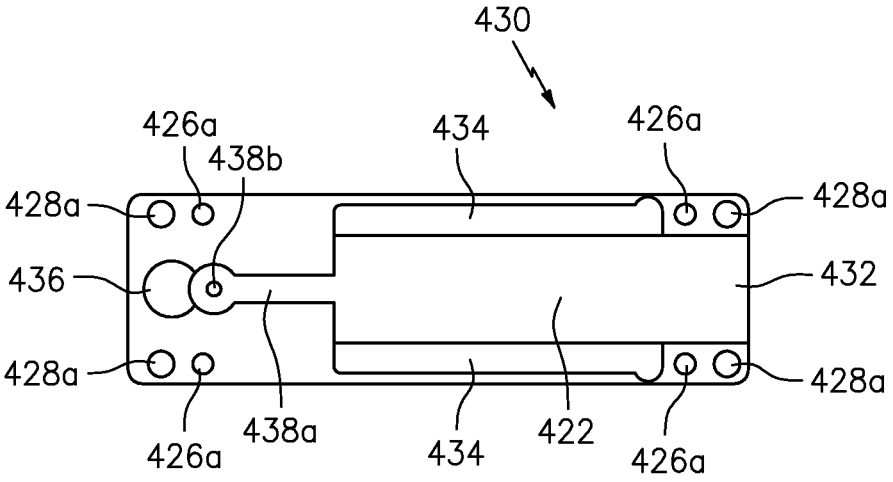
FIG. 6D shows a top plate of the apparatus according to the second embodiment of the present invention
Figure 6E:
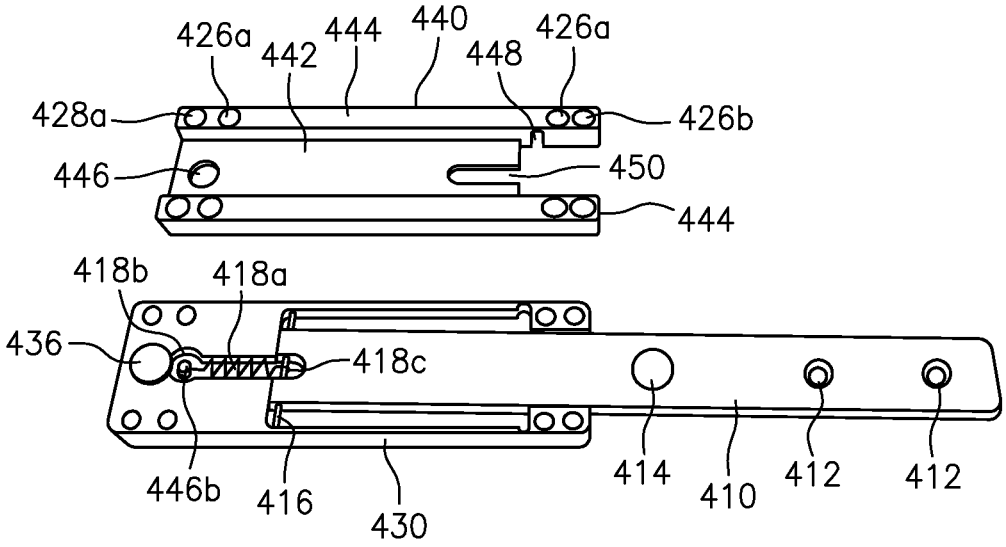
FIG. 6E shows a base plate of the apparatus according to the second embodiment of the present invention and a view of the top plate of the apparatus according to the second embodiment of the present invention with plank inserted in the top plate.

The top plate 430 can be seen in detail in FIGS. 6D and 6E. The top plate 430 may have a substantially flat surface that abuts the surface 200 of the object to which the apparatus 400 is secured. Underneath this flat surface, the top plate 430 provides the space for cavity 422. A plank receiving section 432 is configured in between two tracks 434. The plank receiving section 432 is dimensioned in width so as to fit the plank 410. The tracks 434, elevated above the plank receiving section 432, are configured to receive the ends of the rod 416 when the plank 410 is maintained in the plank receiving section 432. When the plank 410 is contained in the top plate 430, the plank 410 can be slid through the plank receiving section 432 with the rod 416 sliding through the tracks 434.

The top plate 430 is further configured with a magnetic member 436 configured so to be aligned with an opening 446 in the base plate 440, and when the plank 410 is in the slot 424, the magnetic member 414 of the plank 410.

The top plate 430 further includes a spring receiving section 438*a* and a spring attachment component 438*b*. The plank 410 according to this embodiment of the invention includes a spring 418*a* secured to the rod 416 on a first spring end 418*c*, which may comprise a small loop dimensioned for fitting around the rod 416. The spring receiving section 438*a* is dimensioned to fit the spring 418*a* therein, as seen in FIG. 6E. The spring 418*a* is attached to the top plate 440 at a second spring end 418*b*, which may also comprise a small loop dimensioned for fitting around the spring attachment component 438*b*. By securing the plank 410 to the top plate 440 of the housing 420 by way of spring 418*a*, the plank 410 is biased towards the cavity 422, thereby preventing the plank 410 from inadvertently sliding out of the cavity 422.

The base plate 440 of the housing 420, as shown in FIG. 6E, includes a plate 442 having two elongated side walls 444 on each side. The plate 442 and side walls 444 correspond to the slot 424 of the housing 420. The bottom plate 440 is configured for attachment to the top plate 430 via the bore holes 426*a* and screws or bolts 426*b*. When the base plate 440 overlays the plank receiving section 432 and the tracks 434 of the top plate 440, it closes the cavity 422 in which the plank 410 can be stored, inserted or removed. The base plate 440 may further be configured with an opening 446 which is configured to align with the magnetic member 436.

The base plate 440 further includes vertical extensions 448 of the tracks 434 which aid in providing the 180 degree hinge mechanism according to the invention. In a preferred embodiment, the vertical extensions 448 are positioned on the base plate 440 on a side substantially opposing the opening 446, and when the base plate 440 is attached to the top plate 430, opposing the magnetic member 434 and aligning with an end of the tracks 444. The plate 442 is dimensioned in a preferred embodiment so as to be shorter in length than the side walls 444, so that the vertical extensions 448 are constructed in the side walls 444 at a point in between the ends of the side walls 444 and the end of the plate 442. The vertical extensions 448 may be similar in width to the width of the tracks 444 and dimensioned to receive the rod 416 extending from the plank 410.

The 180 degree foldable hinge of the apparatus 400 is similar to that shown in FIGS. 1B-1E and described previously. As shown in FIG. 6A, the plank 410 can be secured inside the cavity 422 of the housing 420, formed in between the top plate 430 and base plate 440. By applying a pulling force to the plank 410, the plank 410 can be pulled out of the cavity 420 by sliding the rod 416 along tracks 444. If the plank 410 is released while being pulled out from the cavity 422, the biasing of the spring 418*a* will cause the plank to retreat back into the cavity 422. The plank 410 can be extended fully out of the cavity 422, while leaving the ends of the rod 416 in the track 444 as the rod 416 reaches the end of track 444 on the top plate, as shown in FIG. 6B. From this position, the plank 410 can be rotated back towards the housing 420 into the slot 424, as shown in 6C. The plank 410 is secured in the slot 424 by the attraction of the magnetic means 414 on the plank to the magnetic means 436 of the housing 420. The base plate 440 may also be configured with a slit 450 at the end of plate 442 to aid in the rotation of the plank 410 into the slot 424. When the plank 410 rotates towards the slot 424, the spring 418*a* may move away from the top plate 430 in the direction of the base plate 440. The slit 450 provides an opening for the spring 418*a* to move into during when the plank 420 is in the slot 424. The process of rotating the plank 410 can be reversed by pulling the plank 410 away from the slot 424, and reversing the rotation until the plank 410 is inserted back into the cavity 422.

The apparatus 400 can be used in combination with additional objects, such as cup holder 300, and surfaces 200, in the same manner as the apparatus 100 according to the first embodiment of the invention.

Figure 7A:
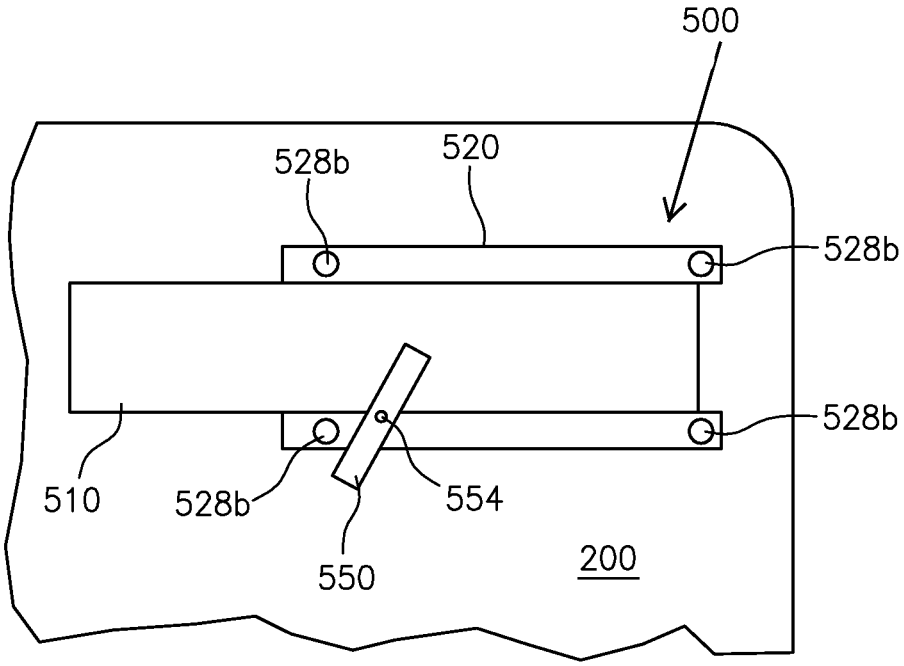
FIG. 7A shows an apparatus according to a third embodiment of the present invention secured to a surface, with the plank in the slot.
Figure 7B:
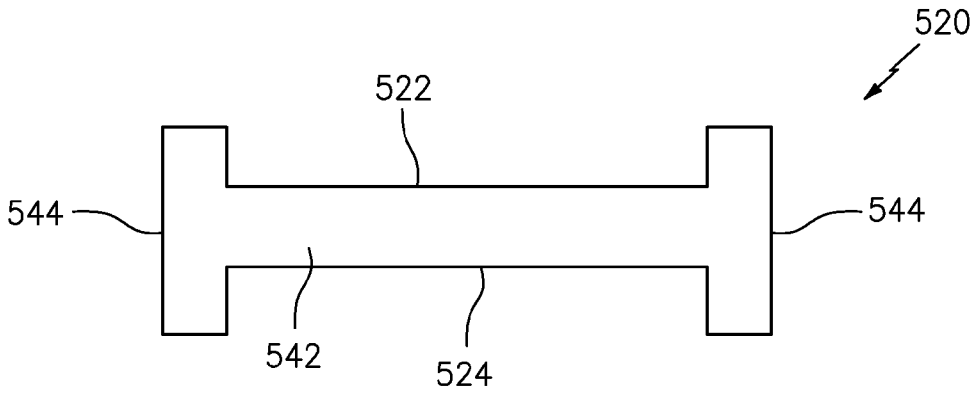
FIG. 7B shows a first, side view of the housing of the apparatus according to the third embodiment of the present invention.
Figure 7C:
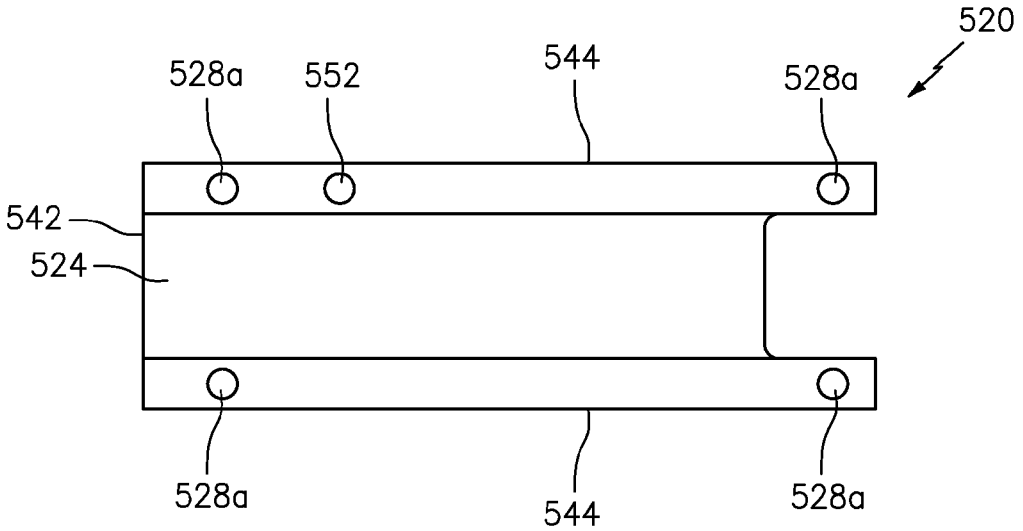
FIG. 7C shows a second, base view of the housing of the apparatus according to the third embodiment of the present invention.
Figure 7D:
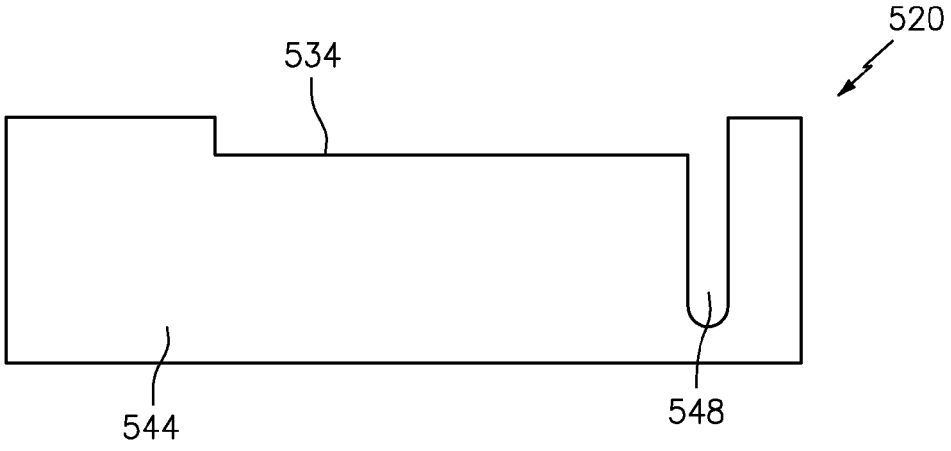
FIG. 7D shows a third, side view of the housing of the apparatus according to the third embodiment of the present invention.

According to a third embodiment of the invention shown in FIGS. 7A-7D, an apparatus 500 may comprise a housing 520 that is comprised of a singular structure and does not include a separate top and base portion secured together. The housing 520 comprises a cavity 522 and a slot 524, formed by a plate 542 placed between two side walls 544. The plate 542 can be positioned substantially in the center of the side walls 544, as shown in FIG. 7B. The housing 520 includes bore holes 528*a* which are configured to receive screws or bolts 528*b* in order to affix the housing 520 to a surface 200.

The apparatus 500 comprises a plank 510 which may similar in configuration to planks 110 and 410 described above. In the embodiment shown in FIGS. 7A-7D, the plank 510 does not include a magnetic member. Rather, the plank 510 is configured to be secured in slot 524 by way of a latch 550. The housing 520 includes a bore hole 552 in a side wall 544 configured to receive a screw or bolt 554 inserted through latch 550. The latch 550 is configured to rotate 360 degrees. As seen in FIG. 7A, the latch 550 can overlay the plank 510 when the plank 510 is inserted in the slot 524 in order to prevent the plank from falling out of the slot 524. When the plank 510 is intended to be moved out of the slot 524, the latch 550 can be rotated so as to be aligned with a side wall 544 and not overlaying the plank 510.

The hinge mechanism of the apparatus 500 is similar to the hinge mechanism described in the apparatus 100 and 400. The housing comprises a track 534 in cavity 522, which when the apparatus 500 is secured to a surface 200, may be enclosed by the surface 200. The plank 510 is configured to be slid through cavity by sliding the rod of the plank 510 through the track 534. The housing 520 further comprises a vertical extension 548 of the track 534. The plank 510 can be rotated into the slot 524 by moving the rod of the plank 510 vertically into the vertical extension 548 and directing the plank 510 into the slot 524. When the plank 510 is in the slot 524, the latch 550 can be turned to overlay the plank 510 and maintain the plank in the slot 524.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed:

1. An apparatus comprising:

a housing comprising:

a slot; and a cavity positioned adjacent to and parallel with the slot; and a plank secured to the housing;

wherein the slot and the cavity are each configured to partially receive the plank and the plank is configured to rotate 180°;

wherein a first end of the plank comprises a rod extending through the plank configured to secure the plank to the housing;

wherein the cavity comprises a track configured to receive the rod and permit lateral movement of the rod and the plank into or out of the cavity;

wherein when the plank is removed from the cavity, the rod is maintained within the track and is configured to allow the plank to pivot towards the housing into the slot; and wherein a portion of the track extends perpendicularly into the slot and said portion of the track is configured to receive the rod to enable the 180° rotation of the plank into and out of the slot.

2. The apparatus according to claim 1, wherein the plank comprises a magnetic member and the housing comprises a first magnetic member configured to align with the plank magnetic member when the plank is inserted into the slot.

3. The apparatus of claim 1, wherein the housing comprises a second magnetic member configured to align with the rod when the plank is inserted into the cavity.

4. The apparatus of claim 1, wherein the housing comprises a first plate configured to be secured to a second plate.

5. The apparatus of claim 4, wherein the cavity is formed in a space between the first plate and the second plate.

6. The apparatus of claim 5, wherein the slot is formed between opposing side walls on the second plate.

7. The apparatus of claim 1, wherein the plank is configured to be affixed to an object.

8. The apparatus of claim 7, wherein the object is a cup holder.

9. The apparatus of claim 1, wherein the apparatus comprises one or more bore holes and the apparatus is configured to be secured to a surface by a bolt or screw inserted through the one or more bore holes.

10. The apparatus of claim 1, wherein the cavity comprises a spring element configured to be secured to the rod and to bias the plank towards the inside of the cavity when the plank is aligned with the cavity.

11. The apparatus of claim 1, wherein the housing further comprises a rotatable latch adjacent to the slot configured to secure the plank in the slot.

12. The apparatus of claim 9, wherein the cavity is formed between the housing and the surface.

13. The apparatus of claim 7, wherein the apparatus is secured to a table and the plank is secured to a table extension configured to align with and extend the table and to rotate 180 degrees to be stored under the table.

* * * * *